United States Patent [19]

Eisermann

[11] Patent Number: 4,727,975

[45] Date of Patent: Mar. 1, 1988

[54] USE-CONTROL SYSTEM

[75] Inventor: Armin Eisermann, Velbert, Fed. Rep. of Germany

[73] Assignee: Schulte-Schlagbaum Aktiengesellschaft, Velbert, Fed. Rep. of Germany

[21] Appl. No.: 768,899

[22] Filed: Aug. 23, 1985

[30] Foreign Application Priority Data

Aug. 24, 1984 [DE] Fed. Rep. of Germany ..... 3431113

[51] Int. Cl.[4] ..... G07F 7/08

[52] U.S. Cl. ..... 194/205; 194/210; 70/276; 235/382.5; 340/825.31

[58] Field of Search ..... 194/205, 210, 213, 214; 70/DIG. 41, 276, 413; 221/66; 235/382, 382.5, 379; 340/825.31

[56] References Cited

U.S. PATENT DOCUMENTS

| | | | |
|---|---|---|---|
| 3,037,605 | 6/1962 | Stackhouse | 194/290 |
| 3,781,805 | 12/1973 | O'Neal, Jr. | 235/382 |
| 3,857,018 | 12/1974 | Stark et al. | 235/382 |
| 3,926,021 | 12/1975 | Genest et al. | 340/825.31 X |
| 4,006,342 | 2/1977 | Baumann et al. | 194/210 X |
| 4,157,534 | 6/1979 | Schachter | 340/825.31 |
| 4,204,635 | 5/1980 | Hofmann et al. | 235/382 |
| 4,305,059 | 12/1981 | Benton | 235/379 X |
| 4,315,247 | 2/1982 | Germanton | 235/382 |

FOREIGN PATENT DOCUMENTS

| | | | |
|---|---|---|---|
| 2017193 | 10/1971 | Fed. Rep. of Germany . | |
| 16700 | 2/1978 | Japan | 194/210 |

*Primary Examiner*—Joseph J. Rolla
*Assistant Examiner*—Edward S. Ammeen
*Attorney, Agent, or Firm*—Martin A. Farber

[57] ABSTRACT

The invention concerns a system for the unsupervised control of the use of lockers or the like in bath houses, reading rooms, hotels or the like in which the locker doors are provided with a deposit lock; in order to optimize the possibilities of variation while retaining the most favorable structural shape, the locks are operated with codes such that the deposit locks can be brought into the position of readiness to receive a code and store the code and the memory is automatically erased upon the return of the deposit coin.

8 Claims, 3 Drawing Figures

FIG. 2
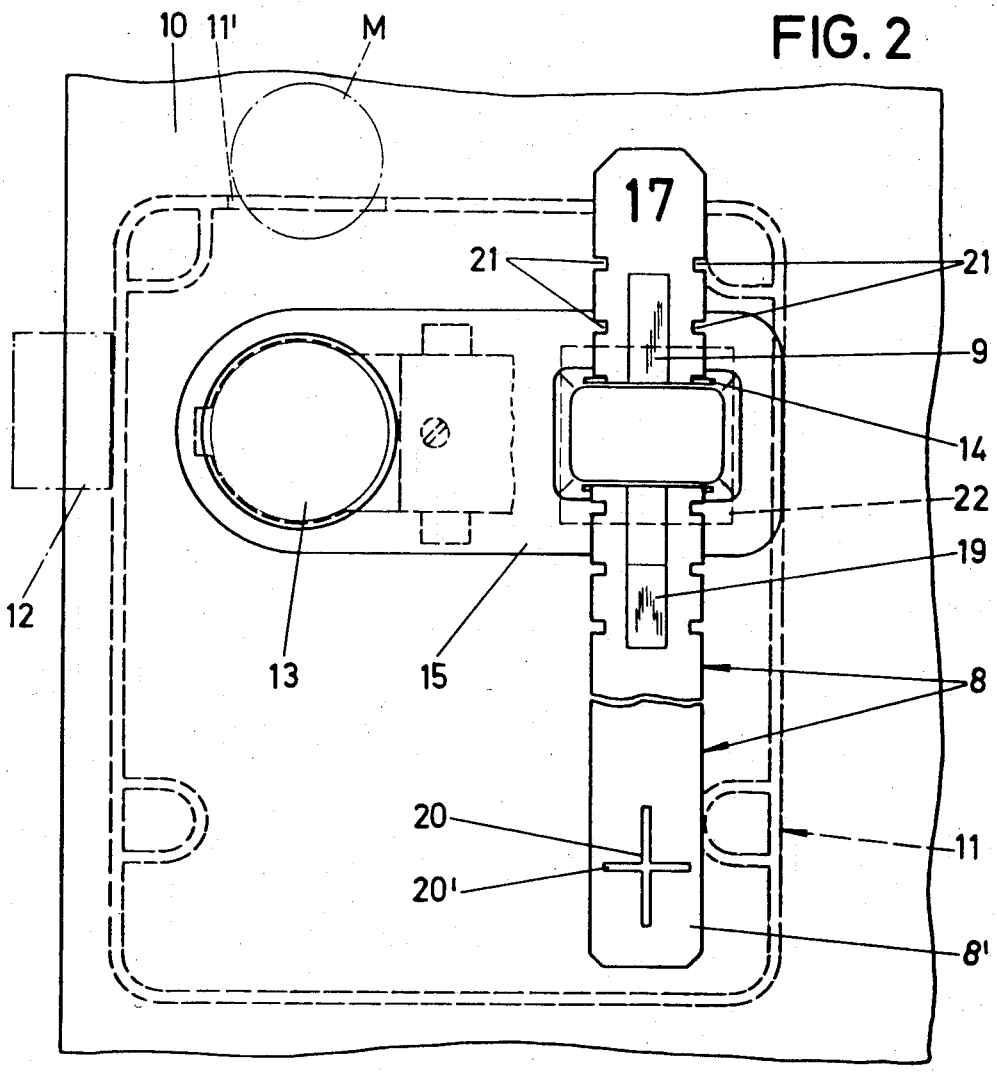
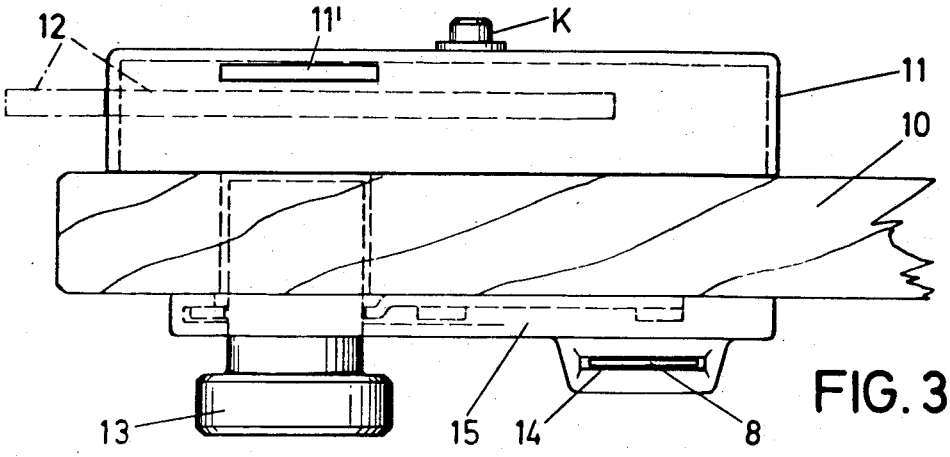
FIG. 3

USE-CONTROL SYSTEM

FIELD AND BACKGROUND OF THE INVENTION

The present invention concerns a system for the unsupervised control of the use of lockers or the like in bath houses, reading rooms, hotels or the like, in which the locker doors are provided with a deposit lock.

In the known systems of this type (Federal Republic of Germany Patent No. 20 17 193), the control elements consist of disks bearing different time coding and each control element which serves as a deposit fits every deposit lock of the bank of lockers. This simplifies handling and has the considerable advantage that the time for which the lockers are occupied is substantially less than the time that the user remains, for instance, in the bath house. The bathhouse user selects for himself or herself a locker, introduces the control element, closes the door of the locker, and pulls the key out. Upon return to the locker, the user opens it with the key, the control element is returned and the key is held fast by the lock. By means of the returned control element the user passes through the exit gate where it can possibly then also be determined whether the user has complied with the stipulated time of stay in the pool.

SUMMARY OF THE INVENTION

The object of the present invention is so to improve a system of this type that, with simpler construction, greater reliability and considerable scope of variation, user-compatible handling is furthermore achieved in particular by dispensing with an exchange of the inserted control element for a key which is withdrawn.

According to the invention the deposit lock (11) can be brought into the position of readiness to receive a code and stores the code in memory and the memory (15) is automatically erased upon return of the deposit coin (M).

As a result of this development, there is established a system for the unsupervised control of the use of lockers or the like which can be easily set up in the most modern adaptation to present-day coding techniques and affords considerable advantages in use. The deposit lock has, for instance, a keyboard for entering a code for the locking function. This keyboard is activated, i.e. made operable, by the insertion of the deposit coin. The user enters any code that he or she desires. By means of it the user can then lock the door. It can be opened again only with this same code. However, coded control elements of any desired system of coding or the like can also be issued from any source of supply. The coding thereof can take place, for instance, in an automatic dispensing machine. The coding need not take into account the subsequent use in the locker lock. Each control element is, rather, capable of operating each lock of the installation. The user can therefore select, for instance, a locker which appears suitable to him or her in the same way as previously. Only from that time on is the locker occupied. If the user inserts the control element and, in addition, the deposit coin, then the locker lock memorizes the code of the control element. From this time on the lock is locked against all other codes. By means of the corresponding control element or the entering of the code, the user can then open and close the locker as frequently as desired. Only when the user surrenders it, has opened the locker door for that purpose and has caused the return of the deposit coin, is the code memory of the lock erased and from that time on the lock is free to be occupied by another user. It is unimportant whether the previous user still remains for a long time somewhere else in the bath house or the like.

The lock of one of many safes can also, for instance, be operated by the coding element, for instance the lock of a safe in a hotel. A safe is provided in each room. The code keyboard or the coding element, for instance the one used for the door of the hotel room, is used, together with the deposit coin, in order to use the room safe for the corresponding period of time. If the room-door code of the control element changes, then the lock of the unoccupied room safe also assumes this different code and permits the use of it for a corresponding period of time. If the deposit lock, by its means for marking the control element, provides the corresponding control element at the same time with an identification marking for the lock and therefore, for instance, a locker number, it is easier for the user to again find his or her locker.

If the command for the erasing of the memory of the deposit lock is not given when the deposit lock is opened by a master key, then a duly authorized person who holds the master key can remove the deposit coins and collect them. This may be advisable, for instance, if someone within a bath house has clearly considerably exceeded the time of use or, for instance, has occupied a locker overnight. The operator of the establishment then opens the compartment, removes the deposit coin, and then closes the compartment again, for instance because he or she has left the possessions of the user in the locker. The user can then open the locker either by entering the corresponding code or by using the correspondingly coded control element and remove his or her things. Upon such opening, the code is then erased so that from that time on the lock is entirely free for a new user. If, at the same time, provision is made that upon opening by a master key an erase command is imparted with time delay to the memory, then this opens up the possibility for a person who is authorized by possession of the master key to remove the deposit coin and thus convert it into a penalty or payment coin. The erasing of the code in the memory then takes place after a short time if the person holding the master key does not close the locker door. As a master key there can be used a purely mechanical key of known type or else a key in the form of a coded element similar to the control element.

If a buffer memory is provided in accordance with the invention, within which a code entered by a keyboard or control element is first of all retained for a short time, then an automatic erasing of this memory can be effected if the user does not actuate the deposit lock within this short time upon or after inserting the deposit coin. This may occur if the user has suddenly decided, for instance, not to use the locker after all. On the other hand, if the user closes the locker then the code is transferred to the main memory which is addressed upon the opening of the deposit lock. In this way, one can also use substantially normal deposit locks supplemented by suitable actuating handles which are activated by coding. If not coded they, for example, actuate nothing. If the buffer memory contains a code, they are connected to the deposit lock; a coin must now still be inserted in the customary manner in order to shoot the bolt forward. When this is done, the code passes into the main memory; if this does not take place within a short period of time, the code is erased and the actuating handle is immobilized.

The object of the invention is shown in the accompanying drawings using a bath house as example.

BRIEF DESCRIPTION OF THE DRAWINGS

FIG. 2 is a front view of a deposit locker lock fastened to a door, with the control element introduced; and FIG. 3 is a top view of the deposit locker lock.

DETAILED DESCRIPTION OF THE PREFERRED EMBODIMENT

Figure 1:
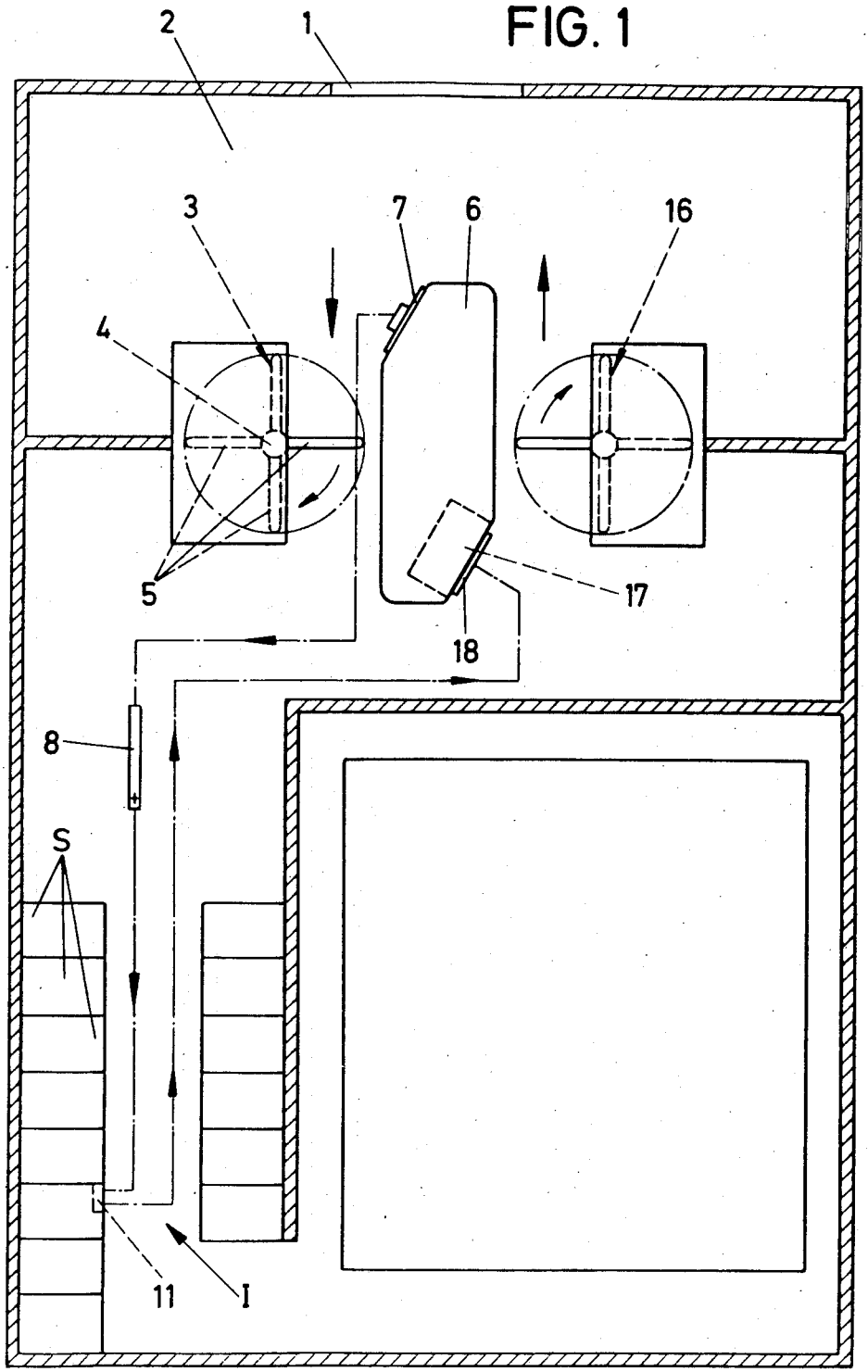
FIG. 1 is a diagrammatic top view of a bath house with corresponding system for the unsupervised control of the time of use.

In FIG. 1, the main entrance to the bath house is designated 1. From it the visitor enters a lobby 2. In order to be able to use the bath house the visitor must pass through an entrance barrier developed in the form of a turnstile 3. The turnstile 3 is mounted on a vertical shaft 4 and has a plurality of turnstile arms 5, arranged at equal angles apart, which prevent unauthorized passage.

Adjacent to the entrance barrier 3 there is a dispensing machine 6 which constitutes a boundary of the entrance lane. The dispensing machine 6 is provided on the entrance side with an operating panel 7. There, the amount of money for each person is paid, as a result of which the dispensing machine 6 then delivers a strip-shaped coded control element 8. In the embodiment shown, the entrance barrier 3 opens upon the delivery of the control element 8 so that the user can pass into the inside of the bath house. However, it is also possible to locate the dispensing machine 6 at a distance from the entrance barrier 3. In such case, the strip-shaped coded control element 8 serves as a ticket in order to be able to pass through the entrance barrier 3. In such event, the entrance barrier 3 would have to have, associated with it, a reading station which scans the control element.

It is possible to arrange the control elements 8 in stacks within the dispensing machine 6. The control elements can also be removed from a supply roll (not shown) contained in the dispensing machine 6. This strip-shaped control element 8 has a coding field 9 which contains the code which is provided either upon the manufacture of the control element 8 or upon the dispensing thereof from the dispensing machine 6 in cooperation for example with a keyboard. With the control element 8 which the user has received, the user can now pass, in the direction indicated by the arrow, to a group of lockers I and, using his control element, occupy any unused locker S. These lockers are provided with different numbers. The deposit lock 11, which is arranged on the inside of a locker door 10, has a bolt 12 which can be locked by turning a knob 13 present on the outside of the door. Actuation of the knob requires, on the one hand, the insertion of the deposit coin M into a coin-insertion slot 11' of the deposit lock 11. On the other hand, the coded-control element 8 must be introduced into a passage slot 14 of a code memory 15. The latter is located on the outside of the door. The coding field 9 of the control element 8 now effects a corresponding coding of the code memory 15. The knob 13 can now be turned, advancing the bolt 12. Upon this passage of the control element 8 through the passage slot 14, the control element is imparted a characterization by a device 22(not shown in detail) arranged in the code memory 15. In the present case, this characterization is the number 17, which agrees with the number 17 present on the locker door. This characterization can consist, for instance, of an unerasable imprint by a printer or of a perforation by a perforator.

In order to be able to open the lockers deposit lock 11, the strip-shaped control element 8 is again pushed into the passage slot 14. As a result of the corresponding coding of the code memory 15, the knob can be turned in the direction of opening, together with the withdrawal of the bolt 12. The door 10 can be opened and the articles stored therein removed from locker No. 17. If the user now wishes to get back the deposit coin M which was inserted, the user must actuate the money-return knob K arranged on the inside of the door on the deposit lock 11. With the return of the deposit coin M, the code of the code memory is erased. The locker can now be used by another person, a different control element having a different code transferring its code to the code memory 15.

When the door is closed it is not possible to open the locker deposit lock by a different coding element 8 since the code does not agree with the value stored in the code memory.

Upon leaving the bath house, the control element 8 is inserted into a test unit 17, arranged in front of an exit barrier 16. The test unit is also arranged in the housing of the dispensing machine 6. If the permitted time of use has not been exceeded, the exit barrier 16, which is developed in the form of a turnstile, can be passed through. However, if the time is longer than the permitted time of use, an additional fee corresponding to the excess time is displayed on a luminous panel 18. Only after payment of the additional fee does the exit barrier 6 open. In certain systems it would be possible to dispense with such a test device 17. This is true if the time of use is not verified.

In order to assure the safekeeping of the control element 8 during the use of the bath house, it is provided on one of its ends 8' with a cross-shaped opening 20, while its other end has recesses 21 on its sides. These recesses enter into engagement with the shorter section 20' of the cross-shaped insertion opening 20, said section 20' extending at a right angle to the length-wise direction of the strip-shaped locking element 8.

Adjoining the coding field 9 there may possibly be provided another coding field 19. It, however, has no effect on the code memory. By means of this coding field 19, codings which are independent of the lock and time coding can be effected, namely in the case of corresponding services within the bath house. When a service is received in the bath house a corresponding coding of this coding field 19 can be effected. The billing is then effected by the test device 17 upon leaving the bath house. The deposit lock 11 can be developed in such a manner that it does not have a money-return button K. In such case, the coin M must be inserted after each intervening use.

What is claimed is:

1. A system for the unsupervised control of the use of lockers and the like having locker doors, comprising a deposit lock on each of the locker doors of the lockers adapted for depositing a deposit coin, the deposit lock having memory means for receiving and storing therein any code of a plurality of codes, the deposit lock including locking means and the memory means being connected to the locking means, the deposit lock being lockable and unlockable upon said memory means receiving said code and upon presenting the same code to the deposit lock, respectively, means for automatically erasing the stored code from said memory means upon return of the deposit coin, control elements each containing a respective code, the deposit lock includes means for reading the code from the control elements, said memory means of said deposit lock enters therein said code, read by the reading means, of any of said control elements, each of said control elements is cooperatable with said deposit lock so as to enable locking every deposit lock of unused lockers of the system, and means on the respective deposit lock for providing the control element cooperating therewith with visible identification of the respective deposit lock.

2. The system according to claim 1, further comprising master key means for opening said deposit lock regardless of the code stored in said memory means of the deposit lock without erasing said memory means of the deposit lock after such opening by the master key means, even upon removal of the deposit coin, until a next opening of the deposit lock.

3. A system for the unsupervised control of the use of lockers and the like having locker doors, comprising a deposit lock on each of the locker doors of the lockers adapted for depositing a deposit coin, the deposit lock having memory means for receiving and storing therein any code of a plurality of codes, the deposit lock including locking means and the memory means being connected to the locking means, the deposit lock being lockable and unlockable upon said memory means receiving said code and upon presenting the same code to the deposit lock, respectively, means for automatically erasing the stored code from said memory means upon return of the deposit coin, master key means for opening said deposit lock regardless of the code stored in said memory means of the deposit lock without erasing said memory means of the deposit lock after such opening by the master key means, even upon removal of the deposit coin, until a next opening of the deposit lock, and said master key means further is for transmitting an erase command with time delay to the memory means for erasing the memory means upon such opening by the master key means when the locker door remains in an open position.

4. The system according to claim 3, further comprising control elements each containing a respective code, the deposit lock includes means for reading the code from the control elements, said memory means of said deposit lock enters therein said code, read by the reading means, of any of said control elements, and each of said control elements is cooperatable with said deposit lock so as to enable locking every deposit lock of unused lockers of the system.

5. The system according to claim 3, further comprising a keyboard which is activated by the deposit coin for providing said code.

6. The system according to claim 3, wherein said memory means includes a main memory and a buffer memory, and wherein said buffer memory receives the code and retains the code for a short period of time and the code therein is only transferred to said main memory if the deposit lock is closed within a predetermined period of time after insertion of the deposit coin.

7. The system according to claim 6, wherein said lock has a bolt operatively connected to said memory means such that the transfer of the code from the buffer memory into said main memory takes place upon a forward movement of said bolt.

8. The system according to claim 6, wherein said lock has an actuating handle and the receiving of the code in the buffer memory activates said actuating handle.

* * * * *